US008327505B2

(12) United States Patent
Smith

(10) Patent No.: US 8,327,505 B2
(45) Date of Patent: Dec. 11, 2012

(54) ADJUSTABLE DOOR STOP SYSTEM

(76) Inventor: B. Jack Smith, Bixby, OK (US)

( * ) Notice: Subject to any disclaimer, the term of this patent is extended or adjusted under 35 U.S.C. 154(b) by 179 days.

(21) Appl. No.: 12/890,759

(22) Filed: Sep. 27, 2010

(65) Prior Publication Data

US 2011/0088221 A1 Apr. 21, 2011

Related U.S. Application Data

(63) Continuation-in-part of application No. 12/579,773, filed on Oct. 15, 2009, now Pat. No. 8,156,613.

(51) Int. Cl.
*E05D 11/06* (2006.01)

(52) U.S. Cl. ..... 16/375; 16/376; 16/374

(58) Field of Classification Search ..... 16/82, 374, 16/375, 286, 376, 377, 386, 262, 265; 292/298, 292/341.18, DIG. 17
See application file for complete search history.

(56) References Cited

U.S. PATENT DOCUMENTS

| | | | |
|---|---|---|---|
| 689,201 | A | 12/1901 | Koester |
| 747,570 | A | 12/1903 | Pickop |
| 975,097 | A | 11/1910 | Wright |
| 1,455,550 | A | 10/1927 | Rodell |
| 1,644,249 | A | 10/1927 | Harrison |
| 1,946,837 | A | 2/1934 | Clayton |
| 2,133,351 | A | 10/1937 | Hansen |
| 2,280,655 | A | 4/1942 | Madsen |
| 2,592,230 | A | 4/1952 | Allen |
| 2,638,620 | A | 5/1953 | Civitelli |
| 2,813,293 | A | 11/1957 | Civitelli |
| 2,993,226 | A | 7/1961 | Baker et al. |
| 3,135,012 | A | 6/1964 | Wessel |
| 3,187,372 | A | 6/1965 | Parsons |
| 3,333,294 | A | 8/1967 | Warner |
| 3,425,386 | A | 2/1969 | Campbell |
| 3,913,171 | A | 10/1975 | Reid |
| 4,738,002 | A | 4/1988 | Shank |
| 4,998,941 | A | 3/1991 | Smith |
| 5,493,760 | A | 2/1996 | Takimoto |
| 5,509,235 | A | 4/1996 | Chander |
| 6,158,086 | A | 12/2000 | De Souza |
| 6,497,005 | B2 | 12/2002 | Apostoloff |
| 6,874,827 | B1 | 4/2005 | Dodson |
| 7,118,143 | B2 | 10/2006 | L'Heureux |
| 7,197,791 | B1 | 4/2007 | Smith |
| 2006/0059659 | A1 | 3/2006 | Kim et al. |
| 2007/0220708 | A1 | 9/2007 | Lewis |
| 2010/0251520 | A1 * | 10/2010 | Corso et al. ..... 16/342 |

FOREIGN PATENT DOCUMENTS

| | | |
|---|---|---|
| EP | 0533273 | 3/1993 |
| EP | 931897 | 7/1999 |
| EP | 1555372 | 7/2005 |
| JP | 2002339635 | 11/2002 |
| JP | 2004076500 | 3/2004 |
| KR | 100895900 | 5/2009 |

* cited by examiner

*Primary Examiner* — Chuck Y. Mah
(74) *Attorney, Agent, or Firm* — Head, Johnson & Kachigian PC

(57) ABSTRACT

An adjustable door stop system. A hinge mounted door has a least one hinge leaf connected to the door, a least one hinge leaf connected to a doorway, and a hinge pin having an axis about which the hinge leaves rotate. A movement control cylinder includes a first finger extending radially and axially, a cylindrical portion substantially parallel to the axis of the hinge pin, and an axial opening. A movement control cap has a second finger extending radially and axially, a cylindrical portion substantially parallel to the axis of the hinge pin, and an axial opening. The cylindrical portion of the movement control cylinder engages the cylindrical portion of the movement control cap to prohibit rotational movement of the door beyond a selected position.

4 Claims, 11 Drawing Sheets

ADJUSTABLE DOOR STOP SYSTEM

REFERENCE TO PENDING APPLICATION

This application is a continuation-in-part of the U.S. patent application Ser. No. 12/579,773 filed Oct. 15, 2009, entitled Adjustable Door Stop System.

BACKGROUND OF THE INVENTION

1. Field of the Invention

The present invention relates to an adjustable door stop system that may be utilized with hinge mounted doors and existing hinge and hinge pins in order to stop movement of the door from moving past a selected position. In particular, the present invention relates to an adjustable door stop system that may be easily adjusted to various positions and will not mar or damage the door and will not mar or damage an adjacent wall or woodwork.

2. Prior Art

Various types of door stops are known to prevent opening doors from causing damage to doors, to door knobs or to adjacent walls or doorways.

While some existing door stops require special hinge leaves, the present invention is directed to a door stop system and a method that may be utilized and added to almost any standard, existing, hinge mounted door.

One known popular type of door stop is held in place by a hinge pin and includes a padded, adjustable post that rests against the doorway on one side and a padded post that rest against the door on the other side. While this functions adequately for its intended purpose, continual pressure by the post against a hollow core door will often result in damage to the door.

In addition, Applicant's prior adjustable door stop, shown and disclosed in U.S. Pat. No. 4,998,941 entitled "Adjustable Door Stop," addresses and solves this problem. Applicant's prior door stop provides an adjustable door stop that will not impact against the door at all and will therefore avoid any damage to the door.

Applicant's prior adjustable door stop system, shown and disclosed in U.S. Pat. No. 7,197,791 entitled "Adjustable Door Stop System" provides a further adjustable door stop system that may be utilized to stop movement of the door at a selected position.

The present invention is directed to a further adjustable door stop system. The present invention provides yet a further solution to address the forgoing problems.

Accordingly, a principal object and purpose of the present invention is to provide an adjustable door stop system that will neither mar nor damage a doorway or a wall adjacent to a doorway.

It is a further object and purpose to the present invention to provide an adjustable door stop system that may be utilized with a wide variety of hinge mounted doors including a wide variety of existing hinges and existing hinge pins.

It is further object and purpose of the present invention to provide an adjustable door stop system that may be readily adapted to new construction as well as to existing hinge mounted doors.

It is a further object and purpose to the present invention to provide an adjustable door stop system where hinge leaves are prevented from axial movement beyond a desired amount.

It is a further object and purpose of the present invention to provide an adjustable door stop system that interfaces and operates with the hinges connected to the door and to the doorway and will not touch or interface with the door or the doorway at all.

It is a further object and purpose of the present invention to provide an adjustable door stop system that mar be readily and quickly adjusted to vary the permissible opening of the door with respect to the doorway.

SUMMARY OF THE INVENTION

The present invention is directed to an adjustable door stop system. The system is used with a hinge pin with a cylindrical barrel having an axis so that it pair of hinge leaves rotate around the axis.

The adjustable door stop system includes a movement controlled cylinder having, a first finger which extends radially and axially. The movement control cylinder also includes a cylindrical portion substantially parallel to the axis of the hinge pin. Additionally, the movement control cylinder includes a axial opening to receive the hinge pin therethrough.

A movement control cap includes a second finger extending radially and axially. The movement control cap also includes a cylindrical portion substantially parallel to the axis of the hinge pin. The cylindrical portion includes an axial opening to receive the hinge pin therethrough.

A plurality of teeth extend outward from the outer surface of the cylindrical portion of the movement control cylinder. A plurality of teeth extend radially inward from the inside surface of the cylindrical portion of the movement control cap. When the movement control cylinder and the movement control cap are engaged with each other, the movement control cap and the movement control cylinder are radially fixed or stationary with respect to each other.

When the door begins to open so that the accompanying hinge leaf moves rotationally, the hinge leaf will continue to move rotationally until it engages the second finger of the movement control cap. Once the other hinge leaf, connected to the doorway, engages the first finger of the movement control cylinder, the movement of the door will be arrested and further movement will be prohibited.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figures 1, 2:
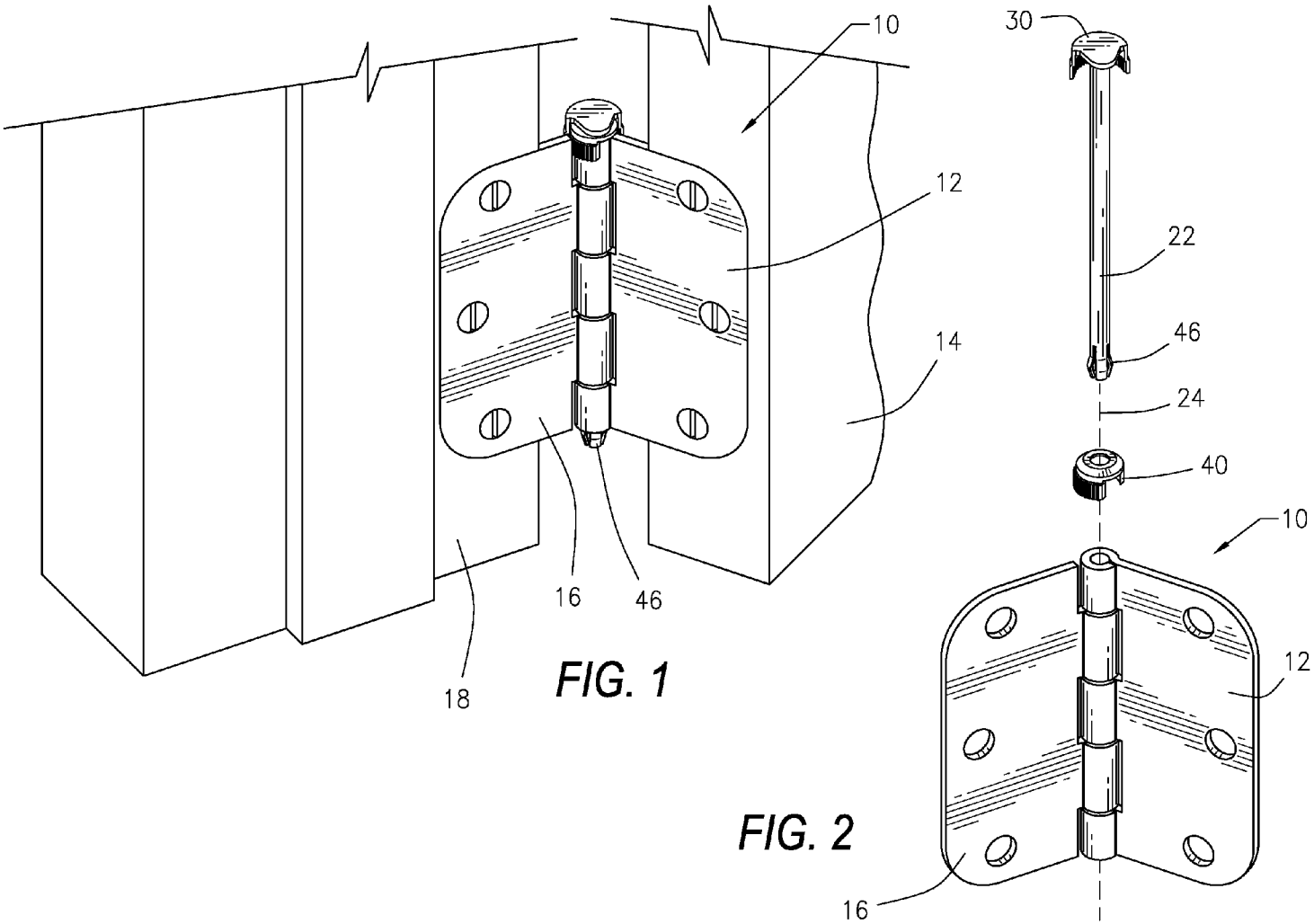
FIG. 1 illustrates a perspective view of first preferred embodiment of an adjustable door stop system constructed in accordance with the present invention.
FIG. 2 illustrates an exploded view of the adjustable door stop system shown in FIG. 1 apart from the door and the doorway.

FIG. 1 illustrates a perspective view of a first preferred embodiment 10 of an adjustable door stop system constructed in accordance with the present invention for a hinge mounted door and FIG. 2 illustrates an exploded view of an adjustable door stop system 10 shown in FIG. 1 apart from the door and doorway.

One hinge leaf 12 would be connected to a door 14 in a known manner, such as with fasteners. Another hinge leaf 16 would be connected to a doorway 18 in a manner, such as with fasteners. The present invention may be employed with a wide variety of doors and doorways.

The adjustable door stop system includes a hinge pin 22 with a cylindrical barrel having an axis (illustrated by dashed lines 24 in FIG. 2) so that the hinge leaves rotate around the axis 24.

Figure 3:
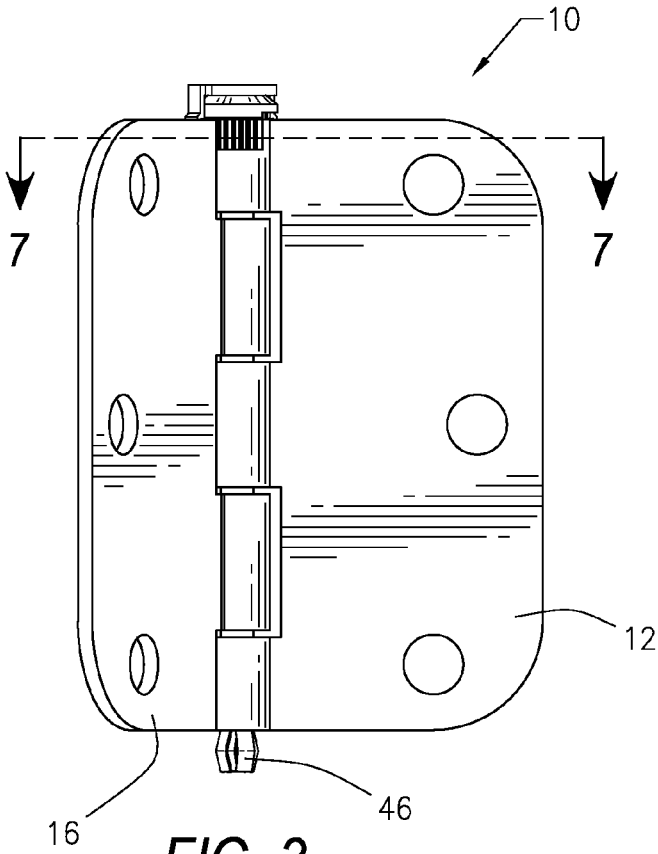
FIG. 3 illustrates a perspective view of the adjustable door stop system shown in FIG. 1 apart from the door and the doorway.
Figure 5:
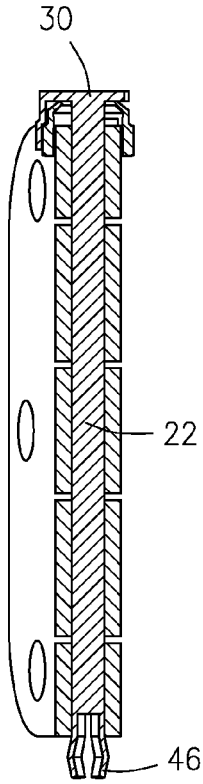
FIG. 5 illustrates a sectional view taken along section line 5-5 of FIG. 4.
Figure 4:
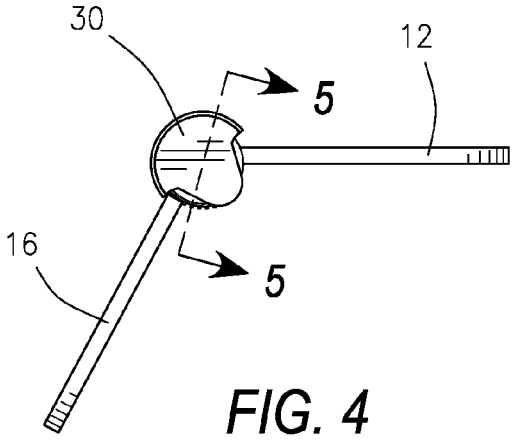
FIG. 4 illustrates a top view of the adjustable door stop system shown in FIG. 3.

FIG. 3 illustrates a perspective view of the assembled adjustable door stop system 10 apart from the door and the doorway. FIG. 4 illustrates a top view of the adjustable door stop system 10 shown in FIG. 3 and FIG. 5 illustrates a sectional view taken along section line 5-5 of FIG. 4. A hinge pin cap 30 extends from and is attached to the top end of the hinge pin 22. The hinge pin cap 30 may be integrally formed with the hinge pin or may be attached thereto.

The hinge pin cap 30 has a first portion 32 extending radially from the top end of the hinge pin. Accordingly, the first portion 32 is perpendicular to the axis 24 of the hinge pin. The hinge pin cap 30 also includes a second cylindrical portion extending from the first portion 32 parallel to the axis of the hinge pin 22. The second portion does not completely encircle the hinge pin 22 so that the edges form shoulders.

A control cap 40 includes a central opening to receive the hinge pin 22 therethrough. The control cap 40 also includes a first portion radially extending from the central opening and a second portion extending cylindrically from the first portion wherein the second portion is substantially parallel to the axis of the hinge pin 22. The second portion does not completely encircle the hinge pin 22 so that the edges form shoulders.

The diameter of the second portion of the hinge pin cap 30 is slightly larger than the diameter of the second portion of the control cap 40.

Figure 6:
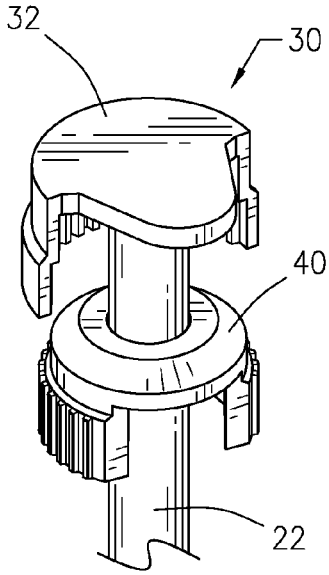
FIG. 6 illustrates a hinge pin and a control cap of the adjustable door stop system shown in FIG. 1.

FIG. 6 illustrates a portion of the hinge pin 22 with the hinge pin cap 30 visible and the control cap 40 separated therefrom.

A mechanism is provided to prevent movement of the hinge pin cap 30 with respect to the control cap 40. A plurality of teeth on the inside surface of the hinge pin cap 30 second cylindrical portion are provided. A plurality of teeth are also provided on the exterior surface of the control cap 40 cylindrical portion so that the teeth engage and mate with each other.

Figure 7A:
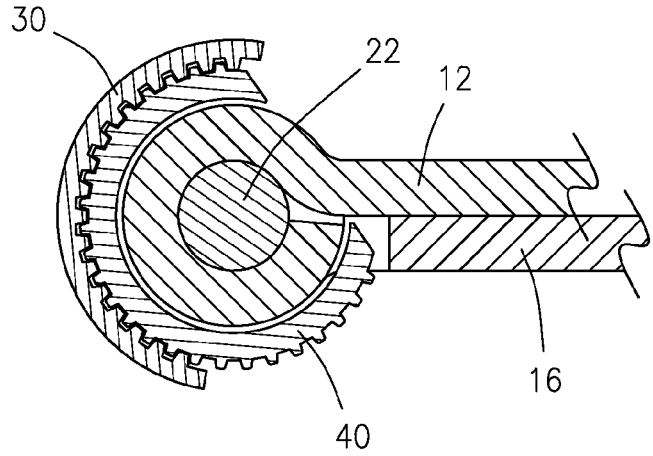
FIGS. 7A, 7B and 7C illustrate alternate positions of the sectional view taken along section line 7-7 of FIG. 3.
Figure 7B:
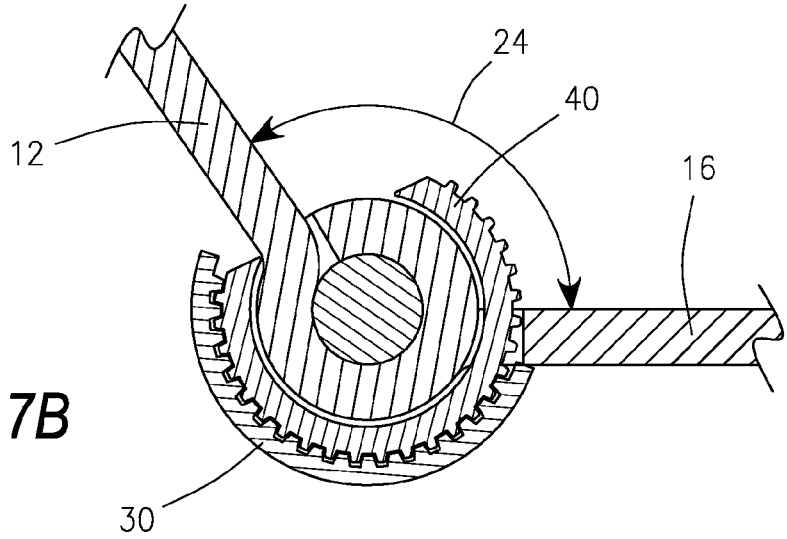
Figure 7C:
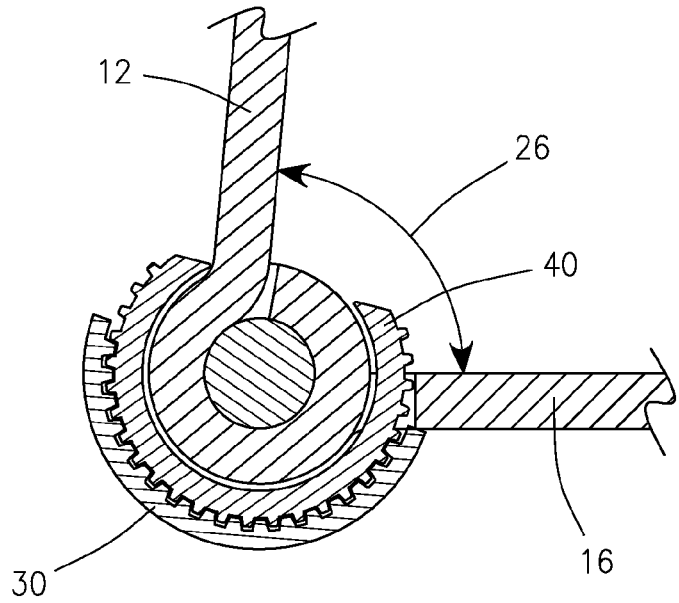

FIGS. 7A, 7B and 7C are sectional views taken along section line 7-7 of FIG. 3 showing the door 14 and hinge 12 in different alternate positions. As best seen in the alternative sectional views 7A, 7B and 7C, a shoulder of the control cap 40 engages the hinge leaf 12 connected to the door (not shown). Additionally, a shoulder of the hinge pin cap 30 engages the hinge pin 16 attached to the doorway (not shown).

The hinge pin cap 30 and the control cap 40 operate together to stop and arrest movement of the door 14 at a desired, selected position prior to either the door or the adjacent wall or doorway being marred.

As seen in FIG. 7A, the door (not shown) is closed with respect to the doorway (not shown) so that the hinge leaf 12 resides against the hinge leaf 16. The hinge cap 30 has been installed with respect to the control cap 40 so that the teeth engage with each other.

When the door begins to open so that the hinge leaf 12 moves in the direction shown by arrow 24 in FIG. 7B, the hinge leaf 12 will move until it engages a shoulder of the control cap 40. Both the control cap 40 and the hinge pin cap 30 will thereafter continue to rotate until the shoulder formed by the opening in the hinge pin cap 30 engages and butts against the hinge leaf 16. Accordingly, the hinge 12 and the door will be prevented from opening past the position as shown in FIG. 7B.

FIG. 7C shows the hinge pin cap 30 installed and mated with the control cap 40 in another alternate position. The door 12 is permitted to move from a closed position to an open position as shown by arrow 26 until the hinge 12 of the door engages the shoulder on the opening of the control cap 40. Thereafter, the hinge leaf 12, the control cap 40 and hinge pin cap 30 will continue to rotate until the shoulder formed by the opening in the hinge pin cap 30 engages in and butts against the hinge leaf 16 of the doorway.

It will be appreciated that in an alternate arrangement (not shown), the control cap 40 would engage the hinge leaf 16 connected to the doorway 18 while the hinge pin cap 32 would engage the hinge leaf 12 connected to the door 14.

Returning to a consideration of FIGS. 1 and 2, a mechanism is provided to prevent any axial movement of the hinge pin 22. A bottom end opposed to the top end of the hinge pin 22 includes a radially enlarged portion 46. The radially enlarged portion is slightly larger than the diameter the openings of the hinge leaves 12 and 16.

A plurality of slots generally parallel to the axis 24 of the hinge pin 22 are provided in the bottom end of the hinge pin 22 extending through. The bottom end accordingly, may be compressed to allow reduction of the enlarged portion during installation of the hinge pin 22 through the hinge leaves. The bottom end is resilient and, once installed, the radially enlarged portion returns to its normal diameter. Accordingly, the hinge pin 22 will resist being removed from the hinge leaves after installation.

In order to utilize the adjustable door stop system 10 of the present invention, the hinge pin 22 having the hinge pin cap 30 at the top thereof is inserted through the opening in the control cap 40 so that the barrel of the hinge pin 22 is received through the opening of the control cap 40. The teeth of the hinge pin cap will mate with the teeth of the control cap 40 in a selected position to allow the door 12 to open a desired distance.

The bottom end of the hinge pin 22 is then inserted through the hinge leaves 12 and 16.

Figure 8:
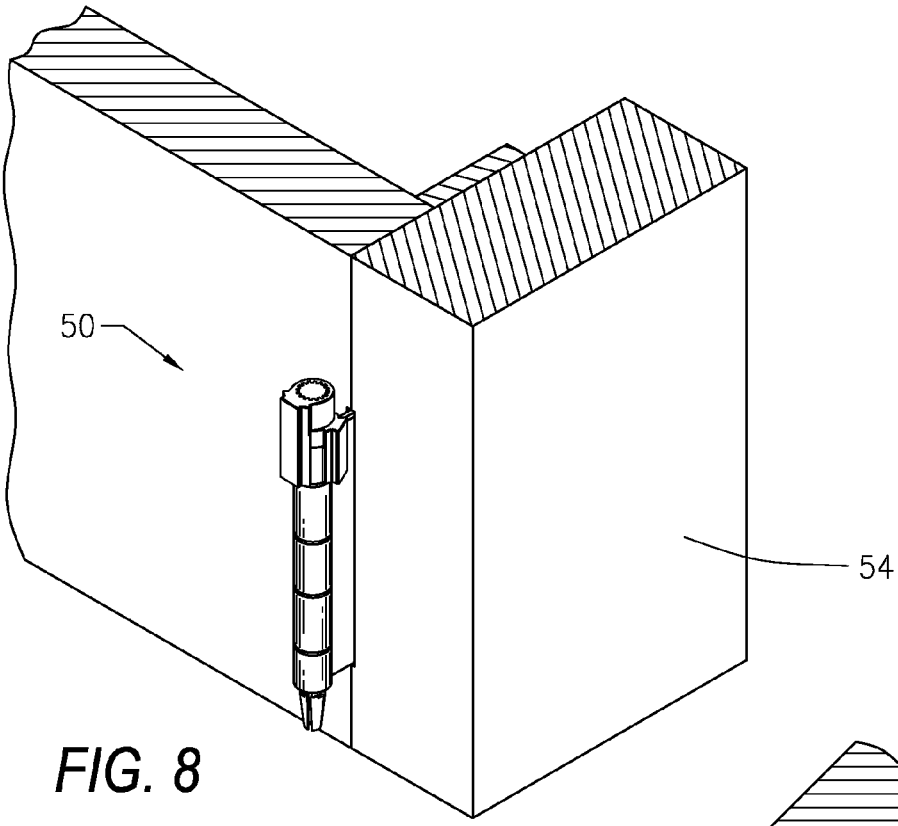
FIGS. 8 and 9 illustrate perspective views of a second preferred embodiment of an adjustable door stop system constructed in accordance with the present invention with a door in alternate positions.
Figure 9:
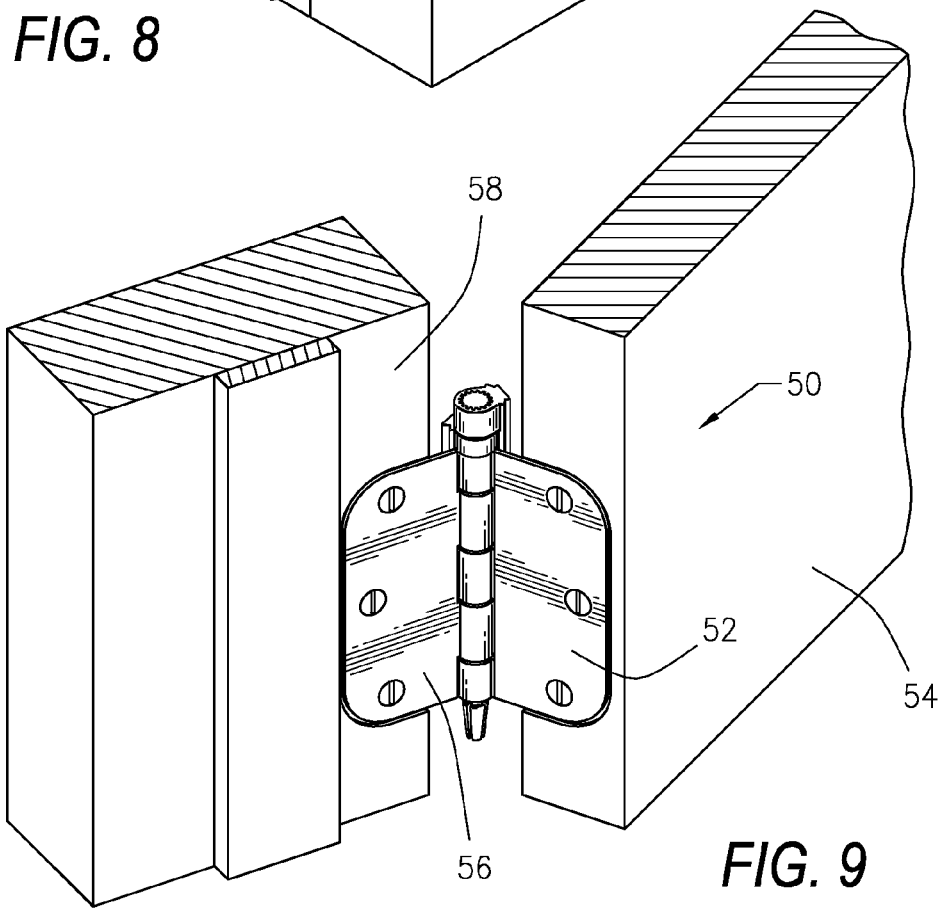

FIGS. 8 and 9 illustrate perspective views of a second preferred embodiment 50 of an adjustable door stop system for a hinge mounted door. FIG. 8 illustrates the door stop system 50 with the door 54 in a closed position while FIG. 9 illustrates the door in an open position.

One hinge leaf 52 would be connected to the door 54 while another hinge leaf 56 would be connected to a doorway 58.

Figure 10:
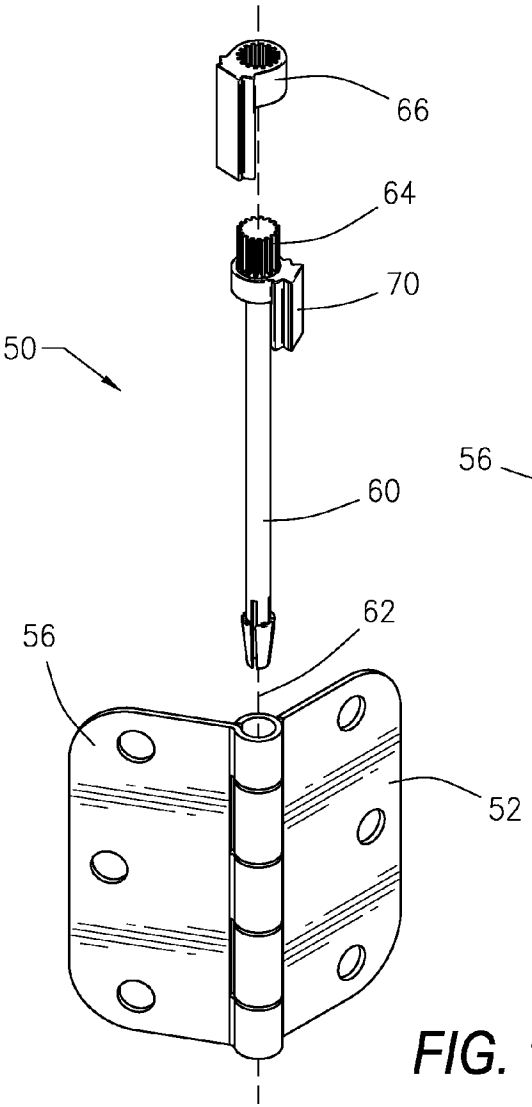
FIG. 10 illustrates an exploded view of the adjustable door stop system shown in FIGS. 8 and 9 apart from the door and doorway.
Figure 13:
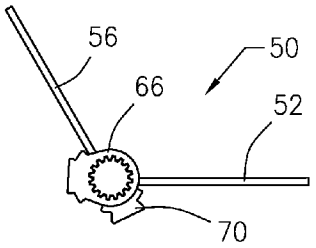
FIG. 13 illustrates a top view and FIG. 14 illustrates a front view of the adjustable door stop system shown in FIGS. 8 and 9 apart from the door and doorway.

FIG. 10 illustrates an exploded view of the adjustable door stop system 50 apart from the door and the doorway. The door stop system 50 includes a hinge pin 60 with a cylindrical barrel having an axis 62 (shown by dashed lines) so that the hinge leaves 56 and 58 rotate about the axis.

Figure 12:
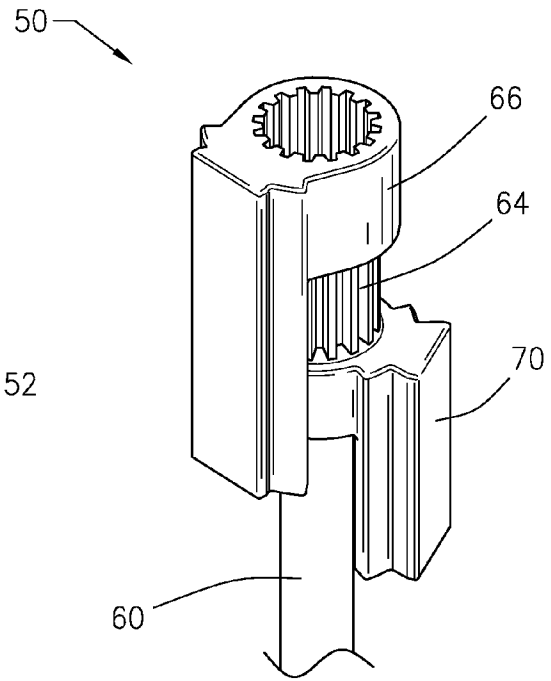
FIG. 12 illustrates a hinge pin and a movement control cap of the embodiment of the adjustable door stop system shown in FIGS. 8 and 9.
Figure 11:
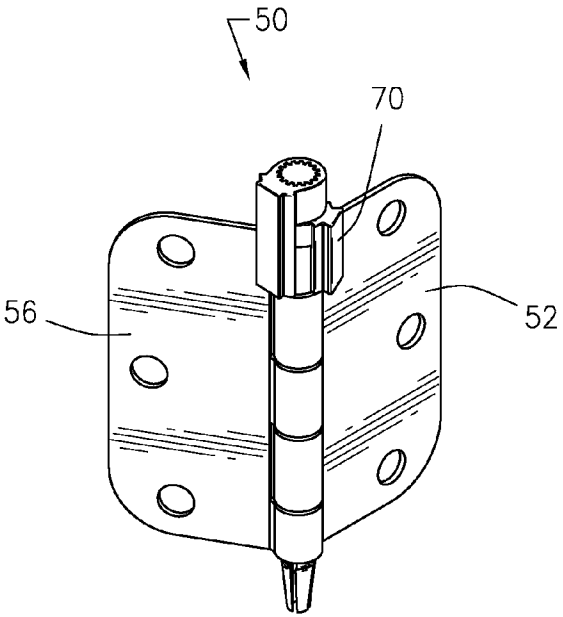
FIG. 11 illustrates a perspective view of the adjustable door stop system shown in FIGS. 8 and 9 apart from the door and the doorway.

FIG. 11 illustrates a perspective view of the adjustable door stop system 50 shown in FIG. 10 fully assembled. FIG. 12 illustrates a portion of the hinge pin 60 with is movement control cap (to be described) partially raised.

As best seen in FIGS. 10 and 12, a first finger 70 extends radially and also axially from a top end of the hinge pin 60. A side of the first finger 70 will engage one of the hinges.

A cylinder 64 extends axially upward from the top of the hinge pin 60 above the level of the first finger 70. The cylinder 64 has a plurality of teeth on the outside surface thereof.

A movement control cap 66 includes a cylindrical opening portion with a plurality of teeth on the inside surface of the cylindrical opening portion. The diameter of the cylindrical opening of the movement control cap 66 is slightly larger than the diameter of the cylinder 64 so that the teeth engage each other.

The movement control cap 66 also includes a second finger 68. The second finger 68 extends radially and also extends axially parallel to the axis of the hinge pin 60. A side of the second finger 68 will engage one of the hinges.

A mechanism is provided to prevent movement of the cylinder 64 with respect to the movement control cap 66 in order to prevent the opening of the door 54 past a desired position. The plurality of teeth on the outside surface of the cylinder 64 mate and engage with a plurality of teeth on the inside surface of the cylinder of the movement control cap 66.

Figure 15A:
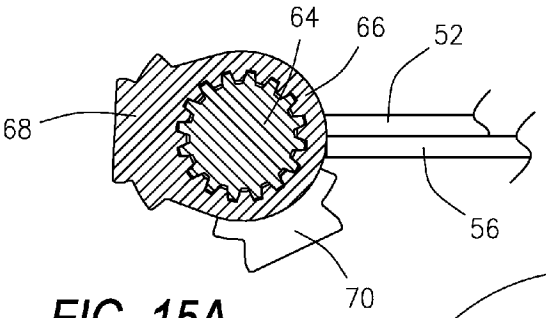
FIGS. 15A, 15B and 15C illustrate alternate positions of the adjustable door stop system taken along section line 15-15 of FIG. 14.
Figure 15B:
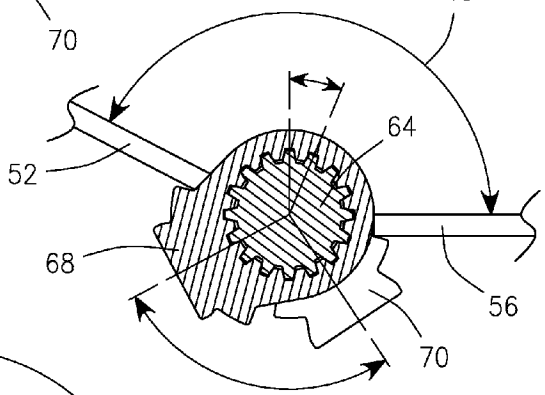
Figure 15C:
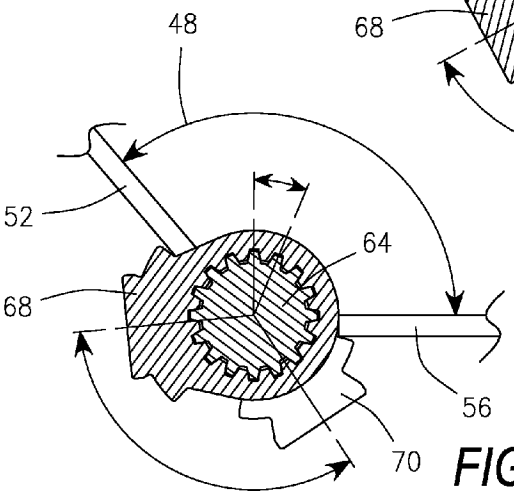
Figure 14:
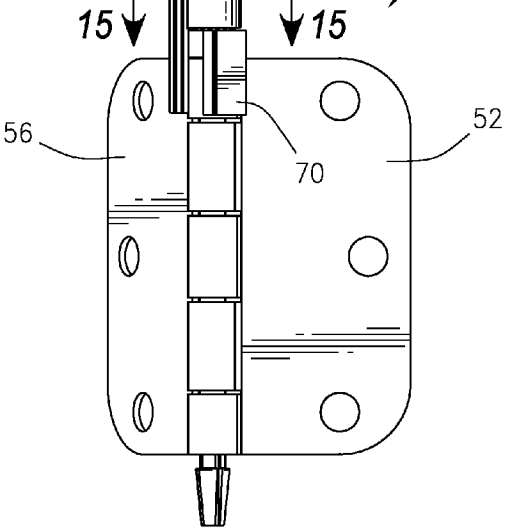

FIGS. 15A, 15B and 15C are sectional views taken along section line 15-15 of FIG. 14 showing the door (not shown) and the hinge 52 in different rotational positions.

As seen in FIG. 15A, the door (not shown) is closed with respect to the doorway (not shown) so that the hinge leaf 52 resides against the hinge leaf 56.

When the door begins (not shown) to open so that the hinge leaf 52 moves as shown by arrow 48 in FIG. 15B, the hinge leaf 52 will move until it engages finger 68.

FIG. 15C shows the movement control cap 66 and second finger 68 installed and mated with the cylinder 64 in another alternate position. The door 12 is permitted to move from a closed position to an open position as shown until the hinge leaf 56 engages the first finger 70. Thereafter, the hinge leaf 52, the movement control cap and first ringer 70 will continue to rotate until the shoulder formed by the second finger 68 engages the hinge leaf 52.

Figure 16:
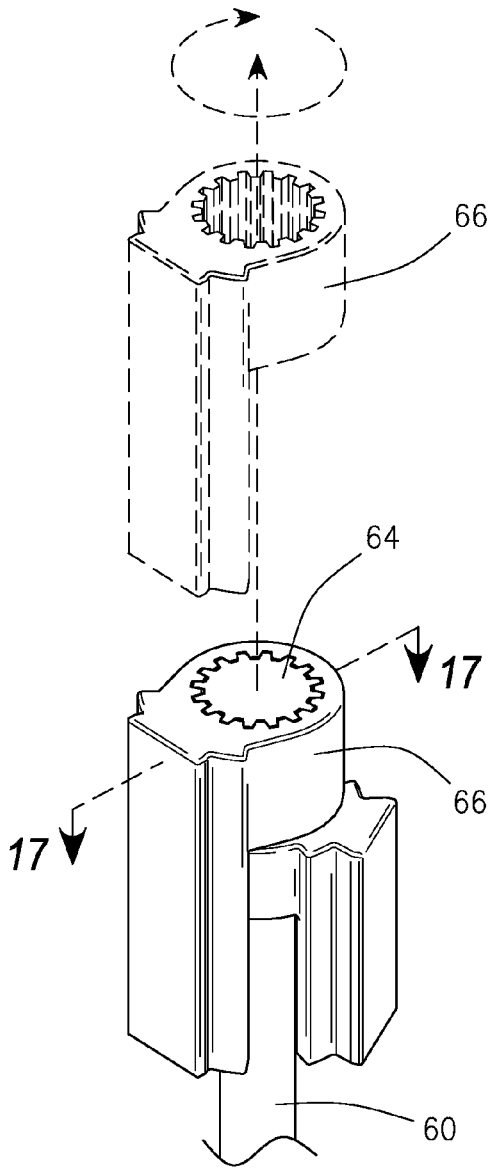
FIG. 16 illustrates a perspective view of a hinge pin and a movement control cap of the adjustable door stop system in a first selected position.
Figure 18:
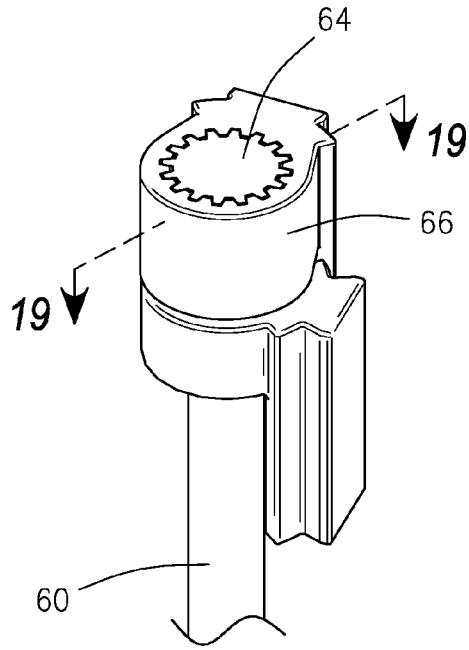
FIG. 18 illustrates a perspective view of a hinge pin and a movement control cap in a second alternate selected position.
Figure 17:
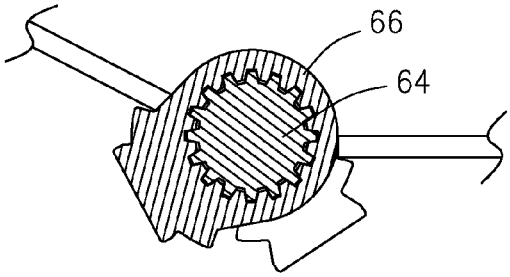
FIG. 17 illustrates a sectional view taken along section line 17-17 of FIG. 16.
Figure 19:
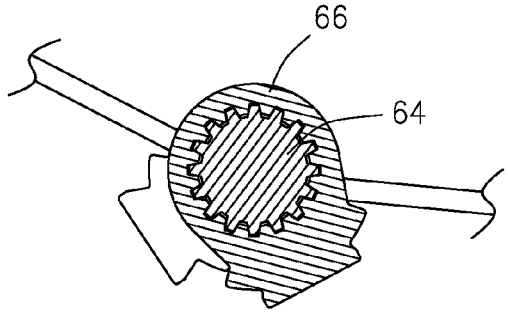
FIG. 19 illustrates a sectional view taken along section line 19-19 of FIG. 18.

FIGS. 16 and 18 show the movement control cap 66 in alternate positions while FIGS. 17 and 19 show sectional views therethrough.

Figure 20:
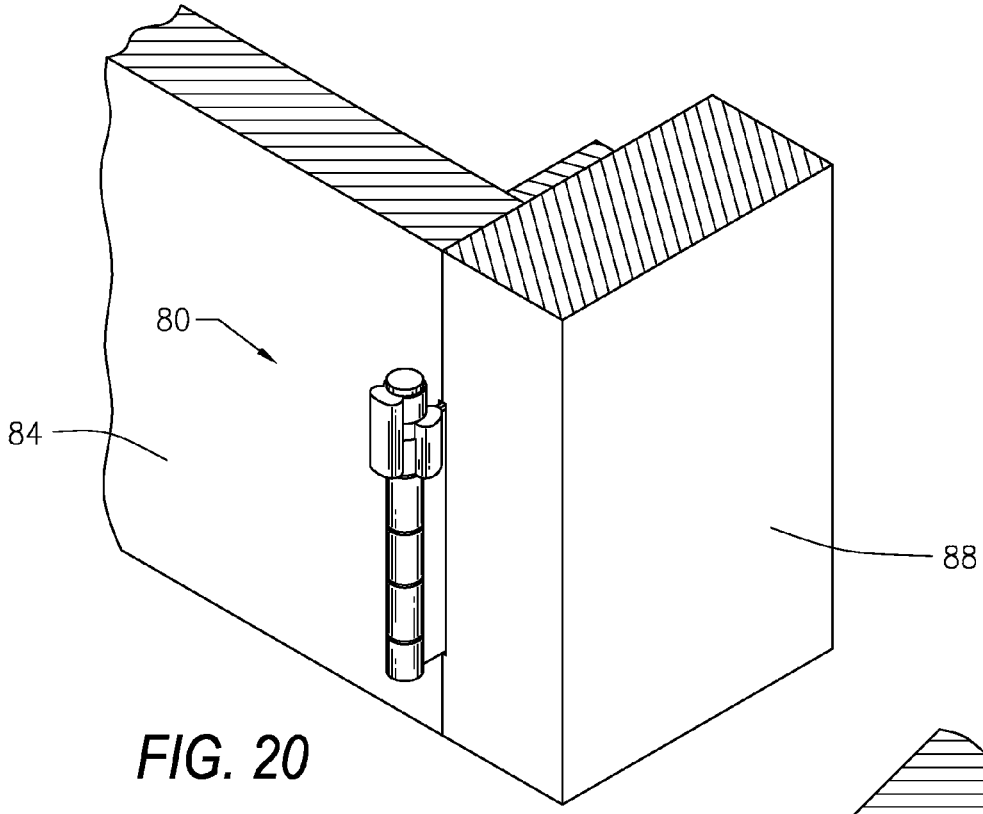
FIGS. 20 and 21 illustrate perspective views of a third preferred embodiment of an adjustable door stop system constructed in accordance with the present invention with a door in alternate positions.
Figure 21:
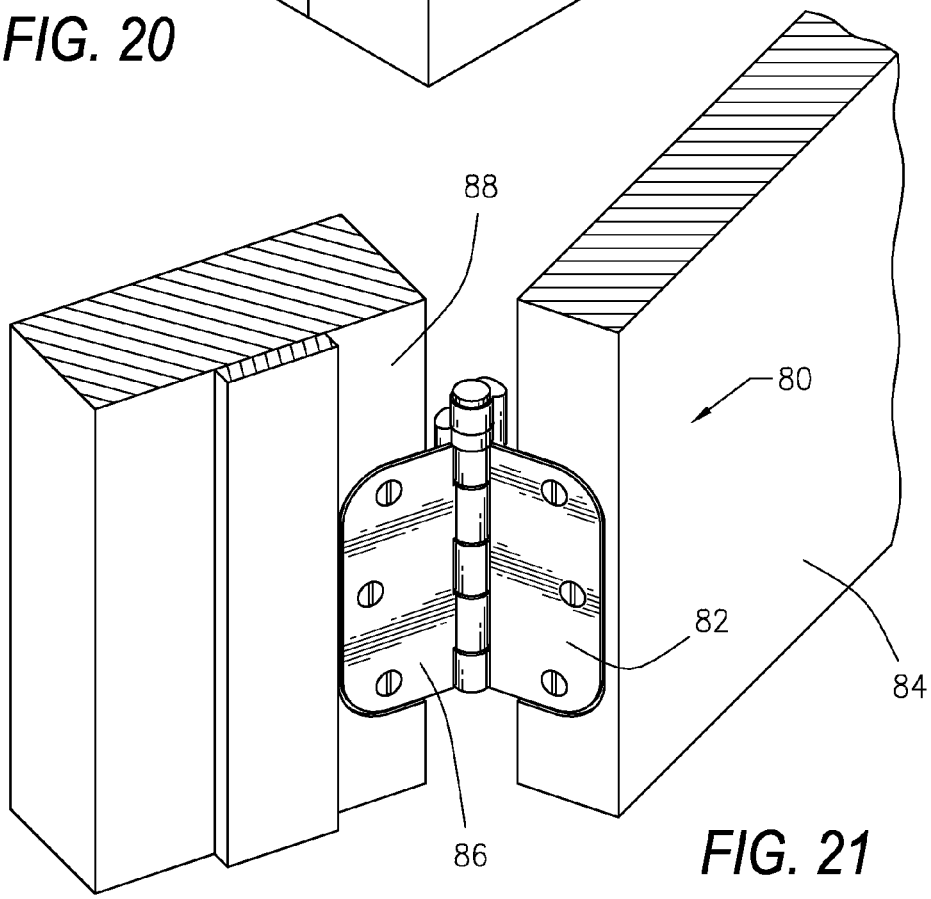

FIGS. 20 and 21 illustrate perspective views of a third preferred embodiment of an adjustable door stop system 80 for a hinge mounted door. FIG. 20 illustrates a door stop system 80 with a door 84 in a closed position while FIG. 21 illustrates the adjustable door stop system 80 with the door 84 in an open or partially open position.

One hinge leaf 82 would be connected to the door 84 while another hinge leaf 86 would be connected to a doorway 88. It will be appreciated that the present invention may be used with various types of known hinges, various types of known hinge pins, various types of doors, and various types of doorways.

Figure 22:
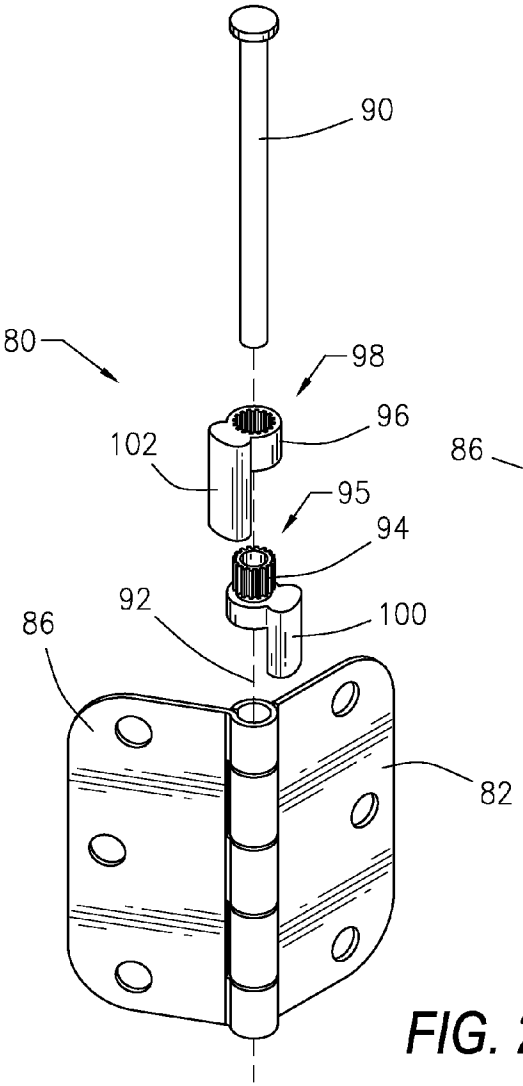
FIG. 22 illustrates an exploded view of the adjustable door stop system shown in FIGS. 20 and 21 apart from the door and the doorway.

FIG. 22 illustrates an exploded view of the adjustable door stop system 80 apart from the door 84 and the doorway 88. The door stop system 80 includes a hinge pin 90 with a cylindrical barrel having an axis 92 (shown by dashed lines) so that the hinge leaves 82 and 86 rotate about the axis 92.

Figure 24:
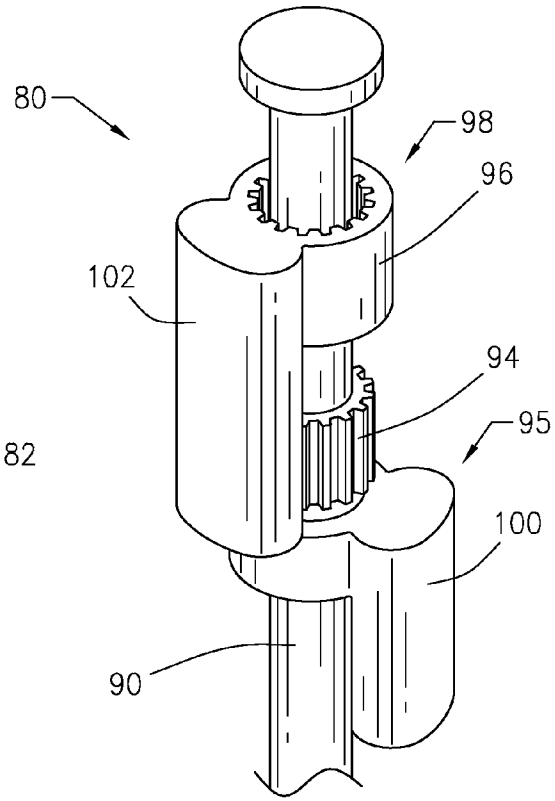
FIG. 24 illustrates a movement control cap and a movement control cylinder of the adjustable door stop system shown in FIGS. 20 and 21.
Figure 23:
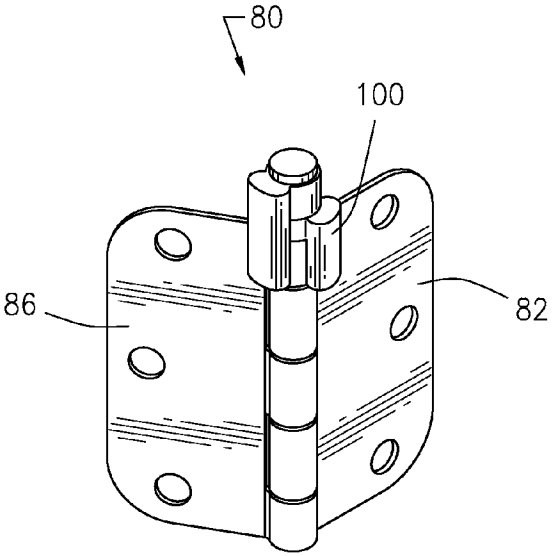
FIG. 23 illustrates a perspective view of the adjustable door stop system shown in FIGS. 20 and 21 apart from the door and the doorway.

FIG. 23 illustrates a perspective view of the adjustable door stop system 80 shown in FIG. 22 fully assembled apart from the door 84 and the doorway 88. FIG. 24 illustrates a portion of the hinge pin 90 with a movement control cylinder 95 and a movement control cap 98 (to be described in detail herein), partially raised and separated from each other.

The movement control cylinder 95 includes a first finger 100 which extends radially and axially therefrom. The movement control cylinder 95 also includes a cylindrical portion 94 substantially parallel to the axis 92 of the hinge pin. Additionally, the movement control cylinder includes an axial opening to receive the hinge pin 90 therethrough. The hinge pin 90 may freely rotate within the cylindrical portion 94.

The movement control cap 98 includes a second finger 102 extending radially and axially therefrom. The movement control cap 98 also includes a cylindrical portion 96 substantially parallel to the axis 92 of the hinge pin. Additionally, the cylindrical portion includes an as opening to receive the hinge pin 90 therethough.

The cylindrical portion 94 of the movement control cylinder 95 is received in and engages the cylindrical portion of the movement control cap 98. In the present embodiment, a plurality of teeth extend outward from the outside surface of the cylindrical portion 94 of the movement control cylinder 95. A plurality of teeth extend radially inward from the cylindrical portion 96 of the movement control cap 98. When the movement control cylinder 95 and the movement control cap 98 are engaged with each other, the movement control cap 98 and movement control cylinder 95 are radially fixed or stationary with respect to each other.

Neither the movement control cylinder 95 nor the movement control cap 98 are fixed or secured to the hinge pin 90 or hinge leaves 82 and 86.

Figure 25:
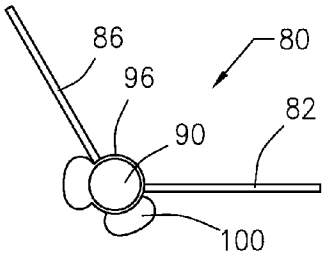
FIG. 25 illustrates a top view and FIG. 26 illustrates a front view of the adjustable door stop system shown in FIGS. 20 and 21 apart from the door and doorway.
Figure 26:
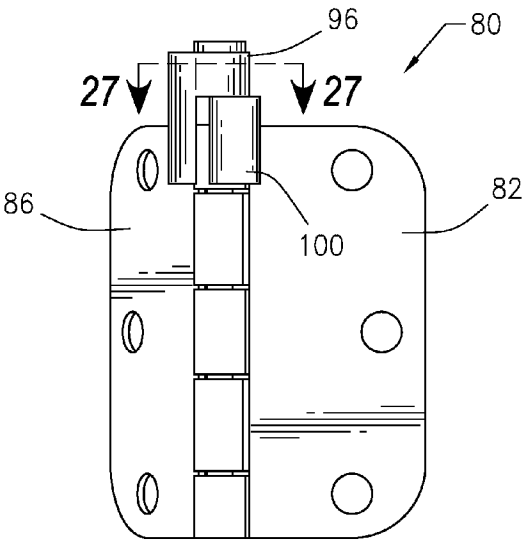

FIG. 25 illustrates a top view of the adjustable door stop system 80 apart from the door 84 and the doorway 88. FIG. 26 illustrates a front view of the adjustable door stop system 80.

Figure 27A:
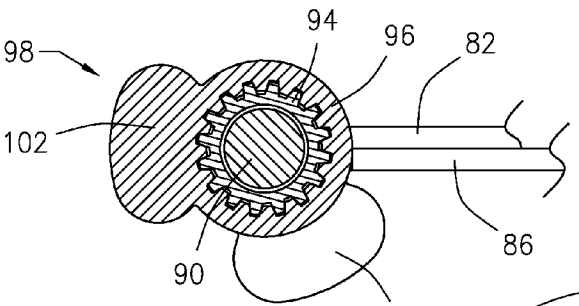
FIGS. 27A, 27B and 27C illustrate alternate positions of the adjustable door stop system taken along section line 27-27 of FIG. 26.
Figure 27B:
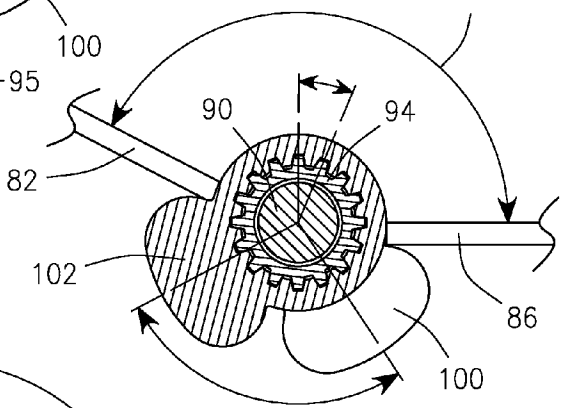
Figure 27C:
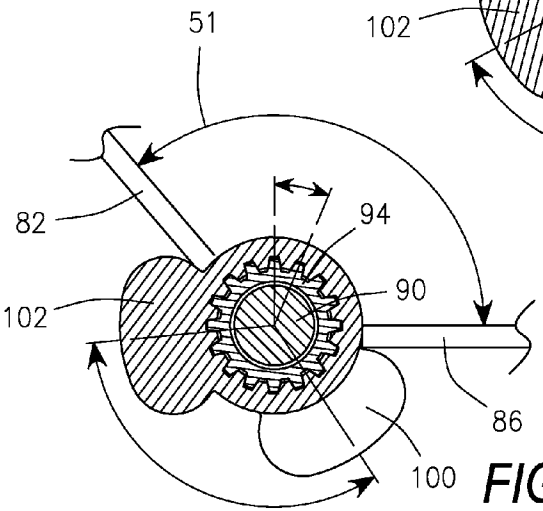

FIGS. 27A, 27B and 27C are sectional views taken along section line 27-27 of FIG. 26 with the door 84 (not shown) and the hinge leaf 82 in different rotational positions.

In FIG. 27A, the door 84 (not shown) would be closed with respect to the doorway 88 (not shown) so that the hinge leaf 82 abuts against the hinge leaf 86.

When the door 84 (not shown) begins to open so that the hinge leaf 82 moves rotationally as shown by the arrow 51 in FIG. 27B, the hinge leaf 82 will continue to move rotationally until it engages the second finger 102 of the movement control cap 98. This causes both the movement control cap 98 and the movement control cylinder 95 to rotate. Once the hinge leaf 86 engages the first finger 100 of the movement control cylinder, the movement of the door 84 will be arrested and further movement will be prohibited.

FIG. 27C shows the movement control cylinder 95 and the movement control cap 98 installed and mated with each other in an alternate position. The doer 84 (not shown) is permitted to move from a closed position to an open position as shown by the arrow 51 until the hinge leaf 82 engages the second finger 102 of the movement control cap. Thereafter, the hinge leaf 82, the movement control cylinder 95, and the movement control cap 98 will continue to rotate until the shoulder formed by the first finger 100 of the movement control cylinder engages the hinge leaf 86.

As can be observed from the foregoing, the permissible opening of the door may be adjusted by adjusting the engagement between the movement control cylinder 95 and the movement control cap 98.

Figure 28:
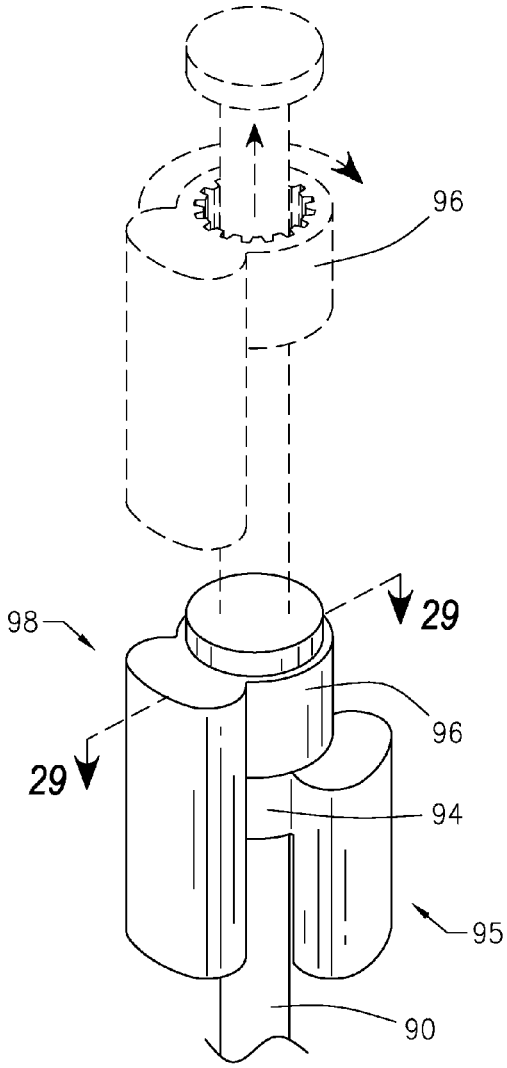
FIG. 28 illustrates a perspective view of the movement control cap and the movement control cylinder in a first selected position.
Figure 30:
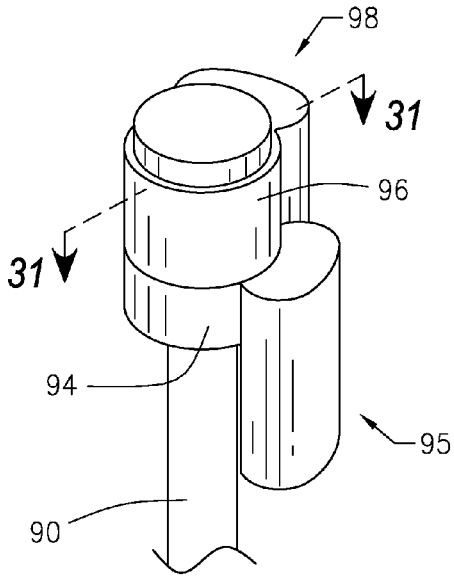
FIG. 30 illustrates a perspective view of the movement control cap and the movement control cylinder in a second selected position.
Figure 29:
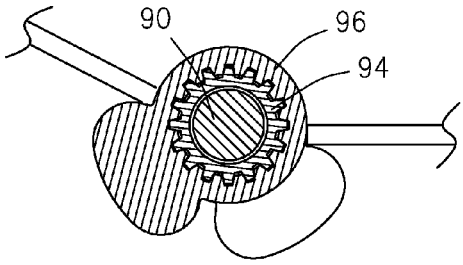
FIG. 29 illustrates a sectional view taken along section line 29-29 of FIG. 28.
Figure 31:
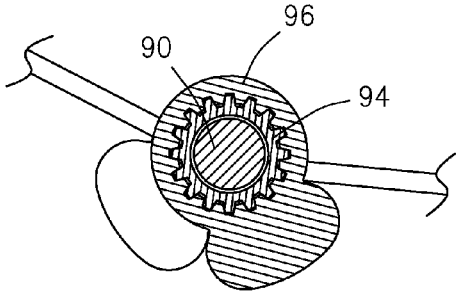
FIG. 31 illustrates a sectional view taken along section line 30-30 of FIG. 30.

FIG. 28 shows the movement control cylinder 95 and the movement control cap 98 engagement in one rotational position while FIG. 30 shows the movement control cylinder 95 and the movement control cap 98 engaged in a second, alternate position.

It will be appreciated that the adjustable door stop system 80 shown in FIGS. 20 through 28 may be retrofit to existing hinge mounted doors or installed in new construction.

In order the install the adjustable door stop system 80 of the present invention, the hinge pin 90 is inserted through the axial opening of the cylindrical portion 96 of the movement control cap 98. Thereafter, the hinge pin 90 is inserted through the axial opening of the cylindrical portion 94 of the movement control cylinder 95. The teeth of the cylindrical portion 96 are engaged with the teeth of the cylindrical portion 94 so that the first finger 100 and the second finger 102 are rotationally positioned with respect to each other. The hinge pin 90 is then inserted all the way through the hinge leaves 82 and 86.

In order to adjust the radial positioning, the reverse procedure is performed and the first finger 100 of the movement control cylinder is adjusted radially with respect to the second finger 102 of the movement control cap.

Whereas, the present invention has been described in relation to the drawings attached hereto, it should be understood that other and further modifications, apart from those shown or suggested herein, may be made within the spirit and scope of this invention.

What is claimed is:

1. An adjustable door stop system for a hinge mounted door assembly having at least one hinge leaf connected to said door, at least one hinge leaf connected to a door way, and a hinge pin having an axis about which said hinge leaves rotate, said door stop system comprises:

a movement control cylinder having a first finger extending radially and axially from said cylinder, a cylindrical portion substantially parallel to said axis of said hinge pin, and an axial opening;

a movement control cap having a second finger extending radially and axially from said movement control cap, a cylindrical portion substantially parallel to said axis of said hinge pin, and an axial opening wherein said cylindrical portion of said movement control cylinder engages said cylindrical portion of said movement control cap; and wherein said first finger of said movement control cylinder includes a shoulder which engages a shoulder on said second finger of said movement control cap to arrest movement of the hinge leaves.

2. An adjustable door stop system for a hinge mounted door as set forth in claim 1 wherein said movement control cap cylindrical portion includes a plurality of teeth which engages a plurality of teeth on said movement control cylindrical portion.

3. An adjustable door stop system for a hinge mounted door as set forth in claim 2 wherein said movement control cap may be repositioned with respect to said movement control cylinder.

4. A method of installing an adjustable door stop system for a hinge mounted door assembly having at least one hinge leaf connected to said door, at least one hinge leaf connected to a doorway, and a hinge pin having an axis about which said hinge leaves rotate, said method comprising;

inserting said hinge pin through a cylindrical portion of a movement control cap having a second finger extending radially and axially therefrom;

inserting said hinge pin through an axial opening of a cylindrical portion of a movement control cylinder having a first finger extending radially and axially therefrom;

engaging teeth of the cylindrical portion of the movement control cap with teeth of the cylindrical portion of the movement control cylinder so that the first finger and the second finger are rotationally positioned with respect to each other;

inserting said hinge pin completely through said hinge leaves; and engaging a shoulder on said first finger of said movement control cylinder with a shoulder on said second finger to arrest movement of the hinge leaves.

* * * * *